US007805213B2

(12) United States Patent
Schwenn

(10) Patent No.: US 7,805,213 B2
(45) Date of Patent: Sep. 28, 2010

(54) WEAVE, A UTILITY METHOD FOR DESIGNING AND FABRICATING 3D STRUCTURAL SHELLS, SOLIDS AND THEIR ASSEMBLAGES, WITHOUT LIMITATIONS ON SHAPE, SCALE, STRENGTH OR MATERIAL

(76) Inventor: Peter Thomas Schwenn, 6514 41st Ave., University Park, MD (US) 20782-2154

( * ) Notice: Subject to any disclaimer, the term of this patent is extended or adjusted under 35 U.S.C. 154(b) by 1027 days.

(21) Appl. No.: 11/544,041

(22) Filed: Oct. 6, 2006

(65) Prior Publication Data

US 2007/0158014 A1 Jul. 12, 2007

Related U.S. Application Data

(60) Provisional application No. 60/723,779, filed on Oct. 6, 2005.

(51) Int. Cl.
*D04H 13/00* (2006.01)
*G06F 19/00* (2006.01)

(52) U.S. Cl. ..... 700/118; 700/131; 156/148; 139/425 R

(58) Field of Classification Search ..... 700/97, 700/98, 117, 118, 119, 182, 130, 131, 140; 703/1, 6; 156/148; 139/35, 116.1, 383, 386, 139/425 R, 449, 450
See application file for complete search history.

(56) References Cited

U.S. PATENT DOCUMENTS

| | | | | |
|---|---|---|---|---|
| 4,752,352 | A | 6/1988 | Feygin | |
| 5,847,958 | A | 12/1998 | Shaikh et al. | |
| 6,165,406 | A | 12/2000 | Jang et al. | |
| 6,308,743 | B1 * | 10/2001 | Debaes et al. | 139/450 |
| 6,401,002 | B1 | 6/2002 | Jang et al. | |
| 6,493,603 | B1 | 12/2002 | Haeberli | |
| 6,745,446 | B1 | 6/2004 | Barlier | |
| 6,819,966 | B1 | 11/2004 | Haeberli | |
| 6,941,188 | B1 | 9/2005 | Arnold, II | |
| 7,110,847 | B2 * | 9/2006 | Ostyn | 700/140 |
| 7,462,321 | B2 * | 12/2008 | Udin | 264/553 |
| 2001/0044668 | A1 | 11/2001 | Kimbrough et al. | |
| 2003/0167099 | A1 | 9/2003 | Kesavadas et al. | |
| 2004/0059454 | A1 | 3/2004 | Backer et al. | |
| 2006/0030964 | A1 | 2/2006 | Silverbrook | |

FOREIGN PATENT DOCUMENTS

| | | |
|---|---|---|
| EP | 0 410 028 A1 | 1/1991 |
| EP | 0 666 163 A2 | 8/1995 |
| WO | WO 96/12610 | 5/1996 |

* cited by examiner

*Primary Examiner*—Charles R Kasenge

(57) ABSTRACT

Weave is a process for fabricating freeform shells, proceeding from a precise definition of a given desired final three-dimensional shape of such a shell, to an optimized parametric mesh of said shape, to physical battens which, once fastened at calculated crossings, realize the final object of use. The initial iso-parametric mesh may be triangulated for increased rigidity. Such a mesh's battens' geometry is precisedly controlled by Weave such that the shell under construction automatically takes on, as it is fastened, the shape and dimensions of the designed fabrication without explicit registration or alignment. Weave places minimal constraints on shape type, complexity, scale and material. Minimal tools are required for preparing and fastening the battens, and no special construction skills or building environment are needed.

2 Claims, 7 Drawing Sheets

Figure 1:
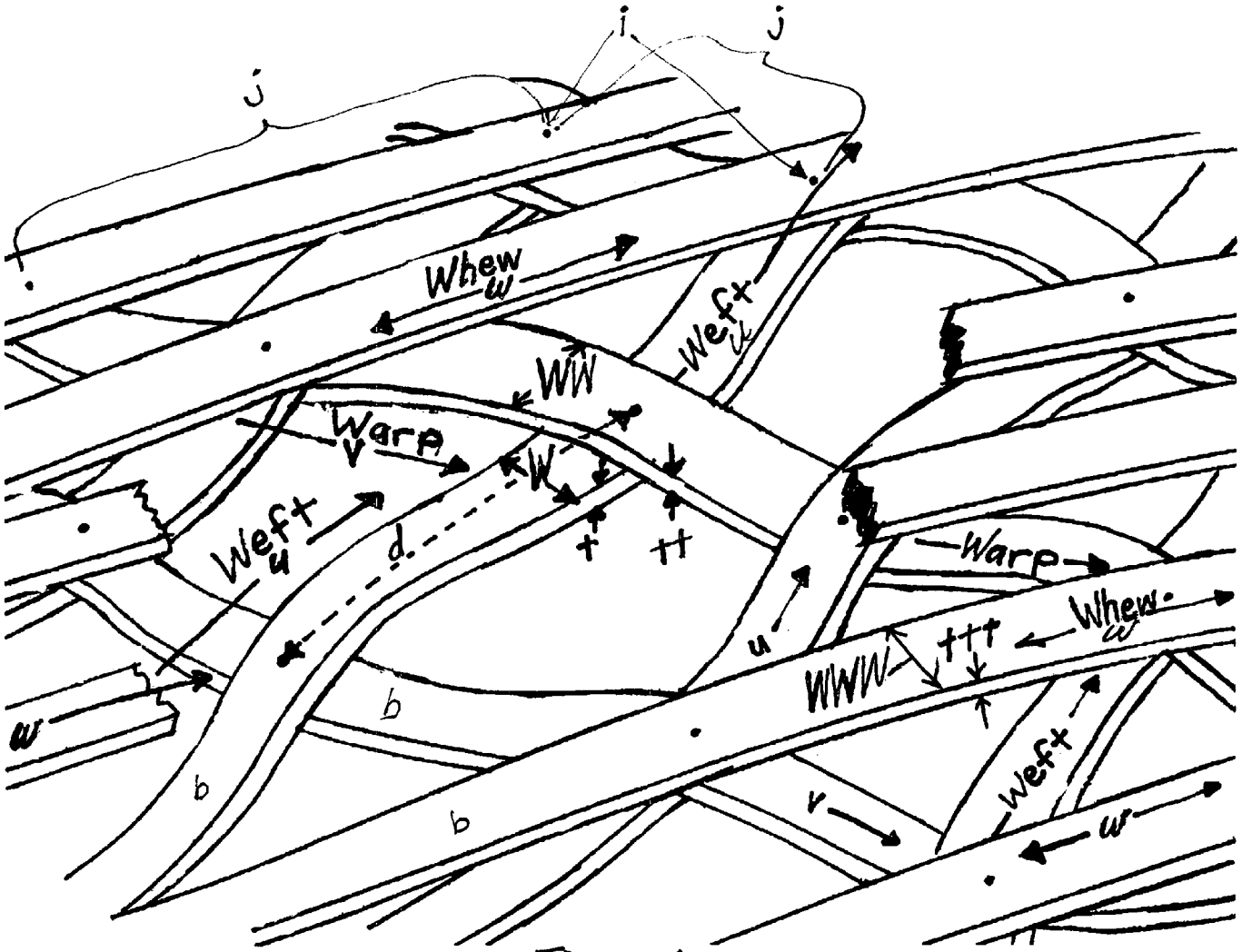

Warp
Weft
Whew
Warp
Weft
Whew
Weft
Whew
Warp
Weft
Whew
Weft
Whew
Warp
Weft
Whew

WEAVE, A UTILITY METHOD FOR DESIGNING AND FABRICATING 3D STRUCTURAL SHELLS, SOLIDS AND THEIR ASSEMBLAGES, WITHOUT LIMITATIONS ON SHAPE, SCALE, STRENGTH OR MATERIAL

CROSS REFERENCE TO RELATED APPLICATIONS

This application claims the benefit of provisional patent application, Country Code and No. 60/723,779, Confirmation No. 9596 filed 2005 Oct. 6, which in turn follows on the Disclosure Document 575435 filed Apr. 19, 2005, both filed by the present inventor.

FEDERALLY SPONSORED RESEARCH

Not applicable

SEQUENCE LISTING OR PROGRAM

A Computer Program illustrating one possible realization of Weave's calculation methods, "Appendix A", which is over 300 lines long, is included as file "Weave39.rvb" on the included duplicate CDROM set. The CDROMs are for the Machine: "IBM PC" and encoded in "Standard ISO CDROM". The file is written in "Standard Window's Ascii", is 28 Kbytes long, and has the Created On Date Oct. 6, 2006.

BACKGROUND OF THE INVENTION

Design and product fabrication of three-dimensional shapes, shells or solids, from formally defined geometry is Weave's technological background. Such formal shape definitions and manipulation are presently often computer based.

Less general, but very common historically and currently, are the design and fabrication of three-dimensional objects and assemblages by means of stations, waterlines and buttocks (from the domain of Naval Architecture), or just one or two of those or their analogues in the architectural field of interest: machinery, dwellings, bridges, towers, large buildings.

PRIOR ART

Problems that the Invention Solves:

Prior fabrication methods for 3D freeform and simpler shapes (and their linked design methods) suffered from one or more constraints (usually most or all) from among: material choice, scale, shape type or complexity restrictions, construction speed, cost of design construction and material, base material/fastener conflict, self-shaping, structural strength limitations, material volume and transport, fabrication tools required, fabricator skill, autonomy of design and fabrication from a base facility, overall simplicity of material and fabrication, attachment of several fabricated objects, attachment of peripheral items to a fabricated object, surface and interior finishing.

Weave suffers in none of these constraint aspects: It is not limited to developable surfaces; nor to freeform surfaces (NURBS ["Non-Uniform Rational B-Splines", the most general and widely used of current CAD/CAM surface modeling] surface creation tools love cylinders, cones and ellipsoids as well as freeform shapes), nor to simple shapes. It can handle 3D surfaces of order 1, 2 and 3 and represents those of order 4 or more with arbitrarily close approximation.

Note: To understand shape type and shape complexity limitations and why a system might best focus on surfaces of order 3, it is important to understand why it is almost always unnecessary and often disadvantageous to go beyond order 3.

NURBS deals with surfaces of any order. But physical beams above molecular scale and below internal-gravity-environment scale do not take curves beyond order 3. Thus no part ever made with a mold built from battens or beams has ever taken on a shape beyond order 3. But any higher order curve or surface can be approximated to any precision by the joining of small 3rd order pieces, and that is how such surfaces (e.g. some airfoils like ultra high speed turbine blades) are sometimes built (if they are CAM machined they can take on 4th order or higher shapes directly).

So why do some design systems provide for or even depend on curves and surfaces of order 4, 5 even 6 or more? Because surfaces of 4 and more often seem to offer more surface inflections and complexity with fewer spline-surface (eg. NURBS) control net points. Unfortunately, often unnoticed undulations away from the current locality of design focus are thus introduced into the surfaces. And because the higher degree surfaces generally lie closer to the control net points and this seems to offer better design ergonomics—more apparent direct control of the shape's manipulation and more convenient means of cinching the surface down on fixed design reference points (this not only produces the same undulations just noted but it draws designer attention in to the very narrow focus domain about given control net points, which in turn gives the designer less overall control of the surface and hides the wider domain influences of the movement of individual control net points. And because many designers and CAD/CAM system designers are unaware of the limit of natural beams to 3rd order curves and surfaces, and are thus unaware that the final object of use is liable to end up 3rd order (because it or its mold are constructed from physical beam elements). Finally, because human design skills are based on visualization and hand-eye experiences that are necessarily those of the 3rd order beams in Nature.

Hence Weave focuses on dealing with 3rd order splines and spline surfaces. For the very rare objects of final use whose function or appearance depends in fact on higher order spline surfaces, Weave depends on the arbitrarily close approximations available in joining several 3rd order segments over just those domains requiring higher order; its method automatically and transparently effecting this whenever the design phase uses a 4th or higher order surface.

Weave constructed objects self-shape automatically (hereafter "auto-shaping" or "self-shaping") from the fastening of weaving elements at the specified [eg. by annotations written directly on Weave's battens] intersections. Raw material may be any solid, semi-solid or composite which is available in linear elements such as one or more of: strip, batten, wire, rod, cylindriccal tube or other cross-section tube. Scale allowed includes anything above the microscopic level where beams can first be formed as emergent material properties of large collections of molecules, to huge constructions such as space radio astronomy antennae (and on up through any scale which avoids heavy internal gravitational influences). Fasteners may be rivets, glue, welding (including impact and tack), no fastener at all (the battens trapping each other by their size and contour in width and thickness), staple, nail, topological trap (like an interlocking solid puzzle), and in fact any fastening means that can pin each intersection "i", such that the corners of the adjoining 3D triangles (or quadrilaterals) share precisely one tangent angle at the point of intersection. Ordinarily the fastener may be of the same material as the batten material.

A given Weave's batten material, dimensions, and contouring in width and thickness may be varied and optimized to achieve virtually any possible strength or strength/weight goal. No special fabricator skill or training is required. Only a fastening tool (if there are any fasteners) is required, and (only in the case of developable surfaces with battens in strip format rather than thin rod or thin tube or wire format) a crimping (or stretching) tool to modify the relative lengths of the left and right edges of the batten strips in way of the developable domains of the designed surfaces. The building material and fasteners may be stored and transported with virtually no voids (e.g. rolled strip). No construction environment other than the minimum space of the final object's volume is required. Construction is quick enough that large and complex structures can be built in isolated or hostile or hazardous environments often with less concern for duration and safety than for prior methods.

Above all Weave allows for the autonomy and independence of the designer/constructor. No access to a home base is necessarily required even in those cases where design criteria are not known in advance and even when the designer/constructor is working alone and/or in distant isolation.

Relevant Prior Art/Developments in Same Technicological Areas

The following patents (indexed 1-15) constitute the Prior Art for Weave in the sense that their inventions lead to fabrication of 3D shells or volumes from formally defined surfaces. Patent numbers (4), (5) & (9) are limited to developable surfaces (and those that use layering techniques [(3), (4), (5), (6), (9) & (10)] are formally limited to developable surfaces because the edge faces of their layers must be developable, though in practice a post-fabrication smoothing (such as sanding or filing) can render the surfaces developable (but not precisedy the non-developable surface(s) as designed); other than (1), all are for prototyping (or mold or other outcome not attaining structural properties of the final object of use, or achieving a final object of use which has no substantial structural properties). (1) has the (very limited) structural properties adequate to its very limited range of shape (models of human heads, especially faces).

Related Patents Inventors (1) U.S. 2001/0044668 A1 Kimbrough et al.
(2) U.S. 2003/0167099 A1 Kesavadas et al.
(3) U.S. 2004/0059454 A1 Backer et al.
(4) U.S. 2006/0030964 A1 Silverbrook
(5) U.S. Pat. No. 4,752,352 Feygin
(6) U.S. Pat. No. 5,847,958 Shaikh et al.
(7) U.S. Pat. No. 6,165,406 Jang et al.
(8) U.S. Pat. No. 6,401,002 B1 Jang et al.
(9) U.S. Pat. No. 6,493,603 B1 Haeberli
(10) U.S. Pat. No. 6,745,446 B1 Barlier
(11) U.S. Pat. No. 6,819,966 B1 Haeberli
(12) U.S. Pat. No. 6,941,188 B1 Arnold, II Foreign Patent Document No. Country & Date

(13) EP 0 410 028 A1 Europe, January 1991
(14) EP 0 666 163 A2 Europe, August 1995
(15) WO 96/12610 W.I.P.O., May 1996

Thus there is no prior art which is unconstrained as to shape and structural strength, nor as to shape and size, nor as to shape and material. Nor is there any prior art which is self-shaping (in the sense of requiring only the relative positioning of the elements and their optional fastening or locking via batten mutual contouring at intersections), nor any which uses parametric meshes as the fundamental element of fabrication (and hence a fortiori none which can capitalize on the advantages of so using said meshes). Weave has none of the above constraints.

Novelty

The applicant's search of USPTO databases using upsto.gov website patent search tools, and a separate search made by a patent attorney, reveal no use in prior or current patents of parametric meshes (or of computer generated meshes of any sort except for classical Cartesian slices aligned with the x, y and z planes) as the final constructed form, nor (in either the design phase or the fabrication phase of 3D objects realized from formally defined surface(s)) any computer testing and optimization performed directly on a parametric mesh of a single element type (the batten Intervals of the final form), nor on any parametric mesh.

Personal communication with the broadly experienced Naval Architect George S. Hazen of Proteus Engineering, Stevensville Md., in 1990, suggests the direct use in the 1970's by a boatbuilder, in the construction of a mold for subsequent fabrication, of a set of wooden "diagonals" (these are not dimensionally parametric but rather Cartesian in x, and radial in y and z [about the x-axis]) of wooden battens overlaying a conventonal framework of wooden "stations". The applicant can find no evidence that these "diagonals" were part of, were generated from, or were parametric mesh curves. And they were not used in the final object of use. Their novelty lay only in the use of diagonals instead of waterline and buttocks.

The use of parametric meshes is nearly universal at some points during the design phase of CAD (Computer-Assisted Design), for the purpose of presenting or further generating a rendering of the shape(s) under design. And during the optimization phase of design, parametric meshes underlie many of the initial passes at generating other types of meshes whose intersection points are subsequently used in generating point sets or contiguous groups of polygonal flats at which finite-element, Navier-Stokes, and other simulation schemes evaluate performance and structural measures. Examples of such measures include fluid and heat flows, tension and compression forces, and vehicle and other motions.

Non-obviousness

In this applicant's many discussions of this issue with engineers, designers and laymen, claims that a woven triangularized parametric mesh originating from a formally defined target shape would likely dictate, through fastening the intersections, that unambiguous and precise constructed shape, and that tools and processes for alignment and dimensioning of objects under construction could largely be dispensed with, have been met always by either rejection, strong doubt or puzzlement.

No written presentation applicant has analyzed, nor any discussion participated in, has revealed anyone who believes either of these two claims to be in any measure obvious.

Given that Weave is novel its benefits (among many others discussed below) in construction speed and overall simplicity (excepting of course the invisible, near instantaneous and costless, computerized complexity of the underlying calculations) would be great, and its value for computer testing and optimizing the direct representation of the final object (as opposed to an intermediate, highly abstract or derived representation), further argue that Weave is non-obvious, since otherwise it would have been realized earlier since it is relatively simple in overall concept and in most detail.

Objects and Advantages.

Weave is distinctive as a design and fabrication method for its lack of restrictions: There are virtually no limits on the size of a Weave (at nano-scales only the formula for a beam's shape must change, and at very large scales the formulas need only be modified for object of final use internal-gravitationaleffects) nor on its material (any solid or semi-solid linear element such as batten, strip, wire, tube, . . . ), nor fastening material (eg. conflicting or problematic fasteners [if any at all are required] need never be used), nor on the shape (neither as to type [developable, undevelopable, conic, flat, freeform, intra-penetrating, "inside-out", high order, . . . ], nor complexity or simplicity), nor on thickness, nor on the structural requirements that it can meet (bridge, balloon, radiator, crushable vehicle, . . . ), nor on its rigidity (from flaccid to ultra-stiff, from easily racking to rigidly non-racking, and always to a specifiable degree) nor on finish (open weave, tight weave, over/under weave, flat weave, woven texture, smooth, . . . ).

Weave is also distinctively advantaged in requiring at most two raw materials, that of the linear elements (the battens "b" —see FIGS. 1, 4, 6 and 9 for graphic definition of the key objects, measure and dimensions of Weave) and if required that of the fastening "f"; and this in turn enables the most efficient of storage and transport formats: rolled strip without voids (along with relatively [to the volume of the batten material] small bags of rivets or other small solid fasteners or with relatively small full containers of liquid adhesive.

At most a single simple fastening tool (such as a pop riveter) is required. Together these give unprecedented autonomy to the fabricator who, given also the speed of fabrication, has virtually no environmental constraints: time, climate, atmosphere, caustic or explosive environs, or gravity.

The fabricator needs next to no training (he/she merely lays out the battens according to their annotated dimension and index, and fastens them at the annotated intersection positions). The designer as well has no great constraints, needing only an ordinary handheld computer to design even the most complex of assemblies.

Weaveing requires no tool, jig, mold or manufacturning environment for measurement, registration, or alignment—a Weave can only take one precise shape during fastening.

Since virtually any designer could perform the fabrication, its worth emphasizing that the autonomy of the Weaveing is unequaled, especially since a very wide variety of fabricated assemblies can be built by Weave from a single material, for example aluminum strip. Thus little or no advance planning or transport or material is required. For example, space colonists armed with rolled titanium strip, monel rivets, a pop riveter and sealing tape could be expected, without any planning or additional supply or communication with their base, to design to unanticipated criteria, and construct and use, a very wide range of machinery, habitation, controlled environment, container, tool, antenna, vessel, vehicle, weapon, constructions for entertainment, and others.

It would be very difficult to exceed Weave in its conservation of resources. There is very nearly no waste in fabrication excepting the option of drilled holes in the battens to accept rivets, and in the optional milling of the battens' contours. What is most important in Weave's near optimal use of resources is that the underlying transformed parametric mesh can be very close to being a physical map of all of the loads expected and nothing else.

Weave provides its own lattice-work as an obvious, robust, convenient, simple and otherwise quite satisfactory basis for fastening subassemblies together. For instance imagine how little would be required in terms of knowledge, practice, material, time, environment and complexity to fasten a Woven or FatWoven wing to a similarly fabricated fuselage, relative to all that required for said wing and fuselage conventionally structured and fabricated.

Not only can material preparation tools be quite limited in number, but said equipment could be very rudimentary as well, consisting of as little as a saw, pencil and hand-drill, or for complex battens, a 2-axis mini-mill with accurate linear feed driven by the design activities' pocket computer. Design and batten fabrication equipment could be straightforwardly miniaturized or specialized for extreme environments such as Space, biological, electric or chemical hazard, or difficult climate.

Weave is suited to objects of precise shape, dimension and alignment because these properties can be dictated by precision in the intersections of battens.

Weave is well suited to rigid, controlled flex, crushable and flexible raw materials and objects of final use.

Weave is well suited to robotic construction because of it simplicity and rote fabrication nature, and to nano construction (above the molecular level) because of its indifference to scale and to material.

SUMMARY

Weave is a Utility Process invention whose method proceeds by computation from the origin of a formal definition of desired final shape and structure represented as three-dimensional surfaces, shells and/or volumes, such as a NURBS file; then through another computation to a parametric mesh on that surface. Concretely, Weave may be realized a set of computer programs and instructions for its use, by the inter-Weaving of stock Woven elements, or in some simpler cases, in extremis, calculated by hand.

This mesh in turn is usually augmented to a triangulated (still parametric) mesh, which may also be spiralized (see footnote 1 well below) in order to provide physical continuity of construction material and greatly limit the number of construction elements (battens "b").

The density and topology of the mesh is controlled by Weave such that the constructed object takes on the shape and measured dimensions of the designed object, without explicit registration or alignment, via the properties of spherical triangles (constructed from batten elements whose edges take, as they must, not simple arc curves but the particular 3D spline beam curves dictated by the surface design) constrained in their length, in their 3D corner angles; and mutually through their neighbors—constrained in the tangency, twist and angular orientation in space at their shared corners.

The length of batten material is precisely adjusted between intersections for the extra length required by interweaving the batten elements. This extra length depends on the thickness and width of the battens at the intersection, on the angles of crossing, the curvature there and the relation of said curvature to the particular over-under topology at the same crossing.

These triangulated meshes of the original 3D objects, taken as the primary structure of (and subsequently constructed as) the final objects of use (prior to surface finishing), are (optionally) optimized for strength, strain, weight, stiffness, permeability, crushing energy and locations, internal movement and change of shape, smoothness and interstitial voids. This optimization is based on the designer's input of intended use, the raw material and its nominal dimensions, expected loads and torsions, expected motions, sub-assembly fastening locations, required finish, and the designer specified relative weighting of all these inputs in an overall optimization measure.

There are many software suites capable of performing such optimization, including several of those mentioned for originating and editing the desired source 3D surface, shell and volume shapes. There are also several suites which specifically target the structural analysis and optimization of assemblages of such shapes, for example Proteus Engineering's Maestro®. A particularly capable suite in this regard is Dassault's Abacus® which also provides the tools for analyzing and optimizing relevant non-linear measures such as crushability, racking, kinematic motions, fatigue and fluid flow most of which are not usually offered in a given structural analysis package.

DRAWINGS

FIG. 1. The parametric dimensions and the primary lengths involved.

Figure 2:
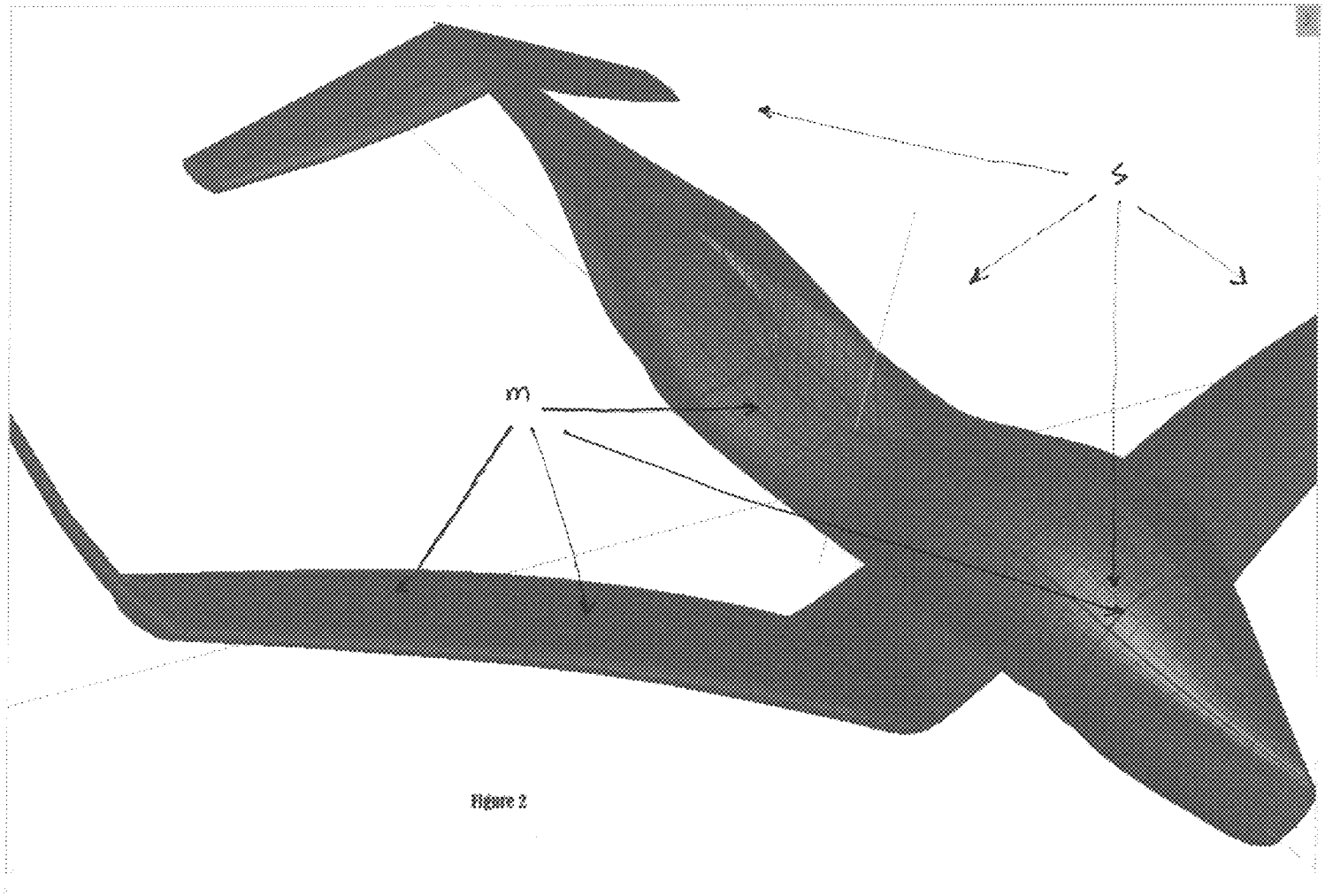

FIG. 2. Example rendered shells with parametric mesh superimposed.

Figure 3:
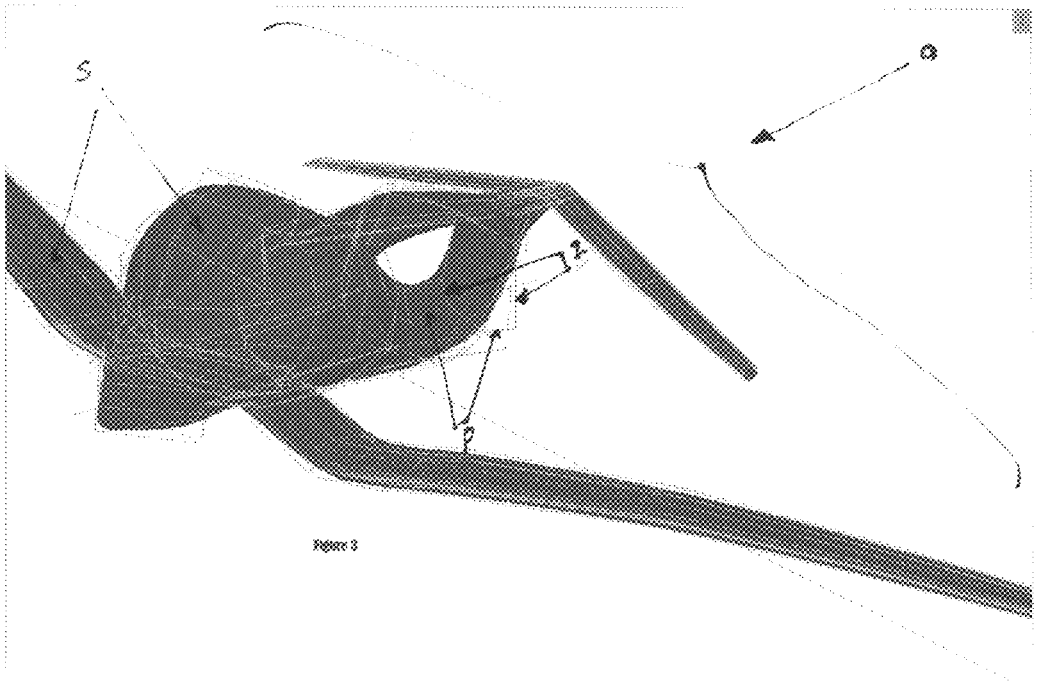

FIG. 3. Rendered shells with spline control net superimposed.

Figure 4:
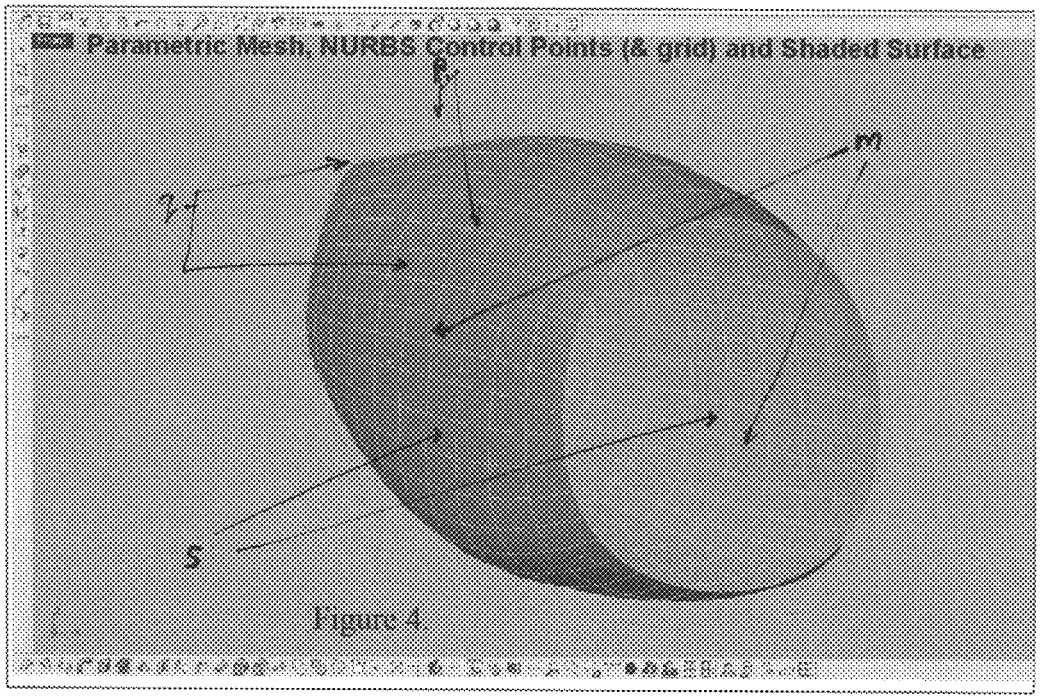

FIG. 4. Base parametric mesh with spline control net and parametric dimensions superimposed.

Figure 5:
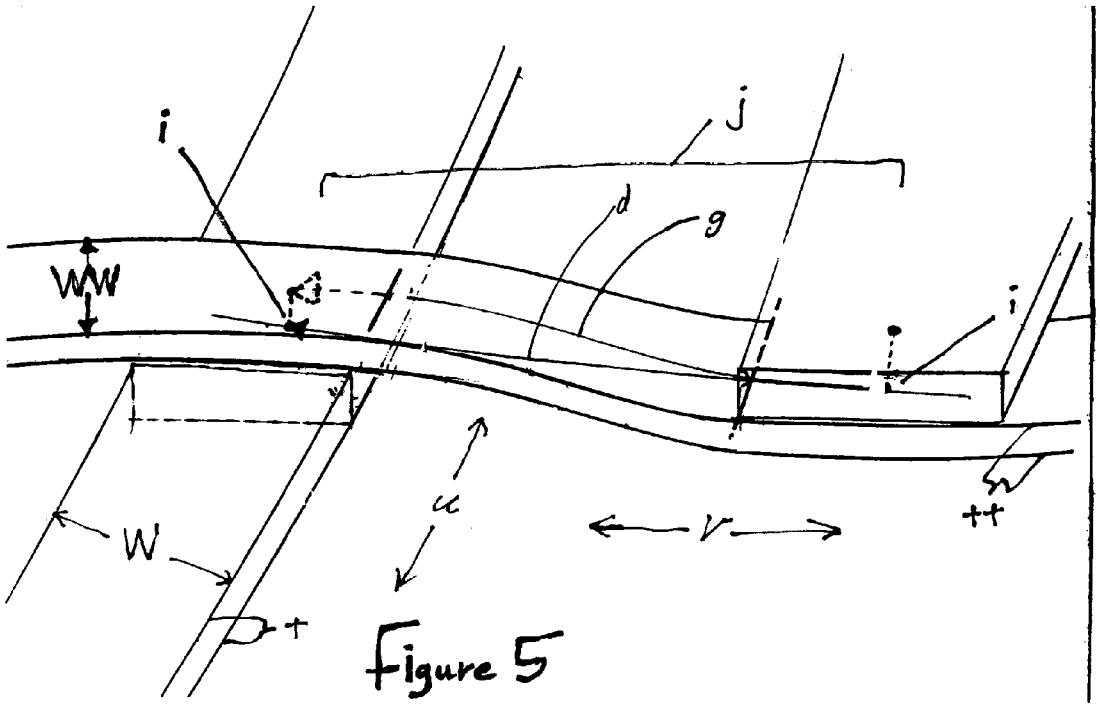

FIG. 5. Two elemental Weft/Warp crossings showing fundamental topology, widths, thicknesses and lengths of intercrossing.

Figure 6:
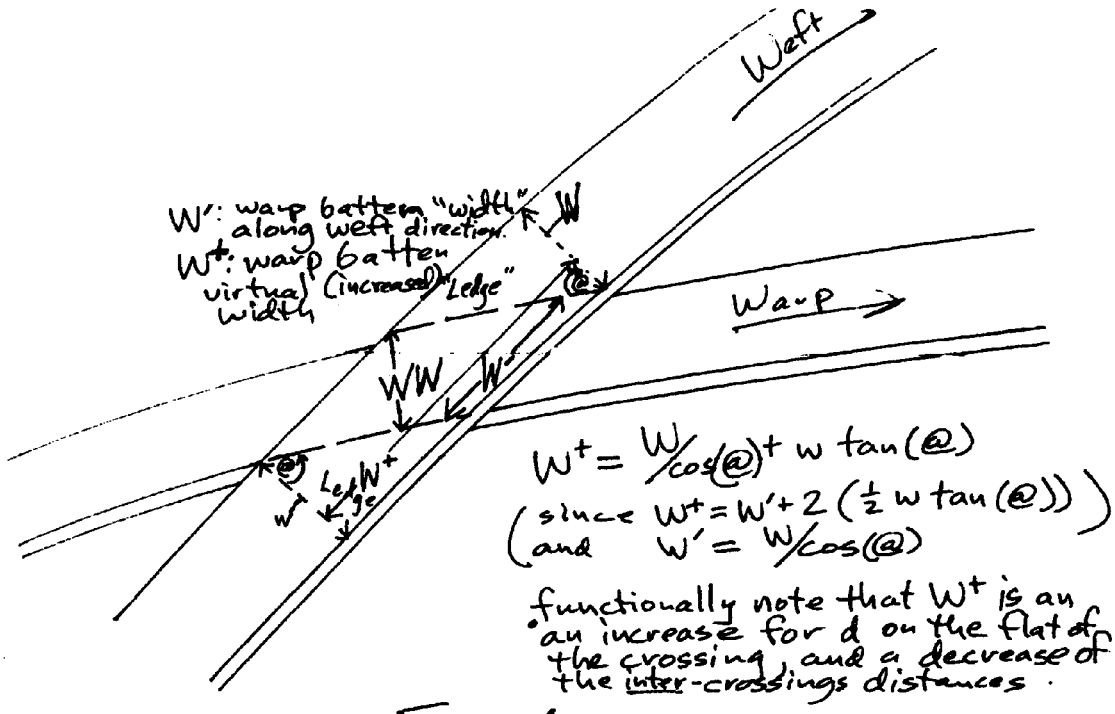

FIG. 6. Illustration and calculations of the lengthening of inter-crossing girth by degree of non-orthogonal intersection.

Figure 7:
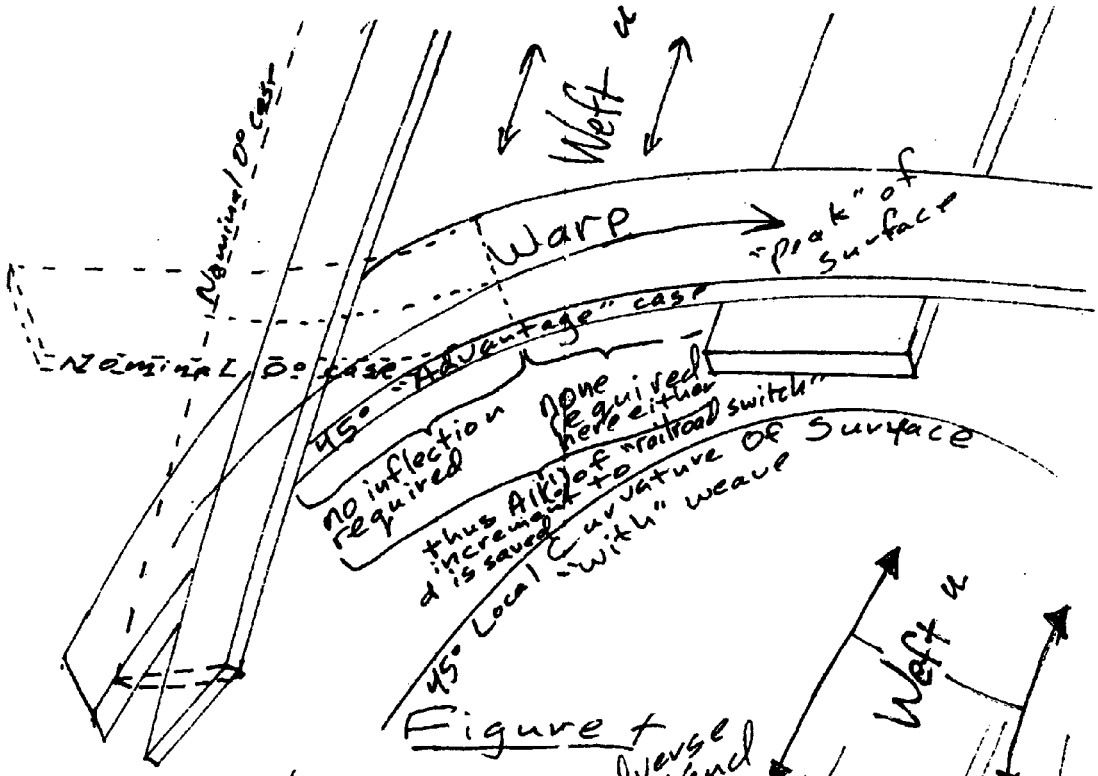

FIG. 7. Illustration of the lengthening of inter-crossing girth due to surface curvature at the intersection.

Figure 8:
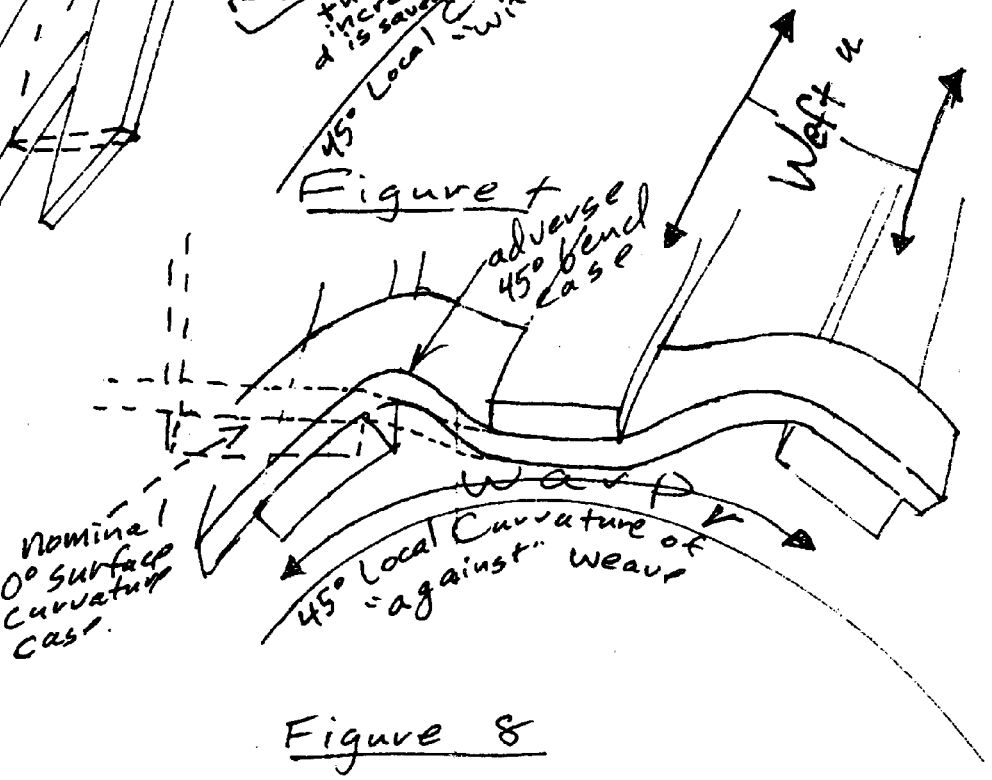

FIG. 8. Illustration of the local-curvature supplemental lengthening (or shortening) of inter-crossing girth due to "Advantageous" or "Disadvantageous" over/under topology.

Figure 9:
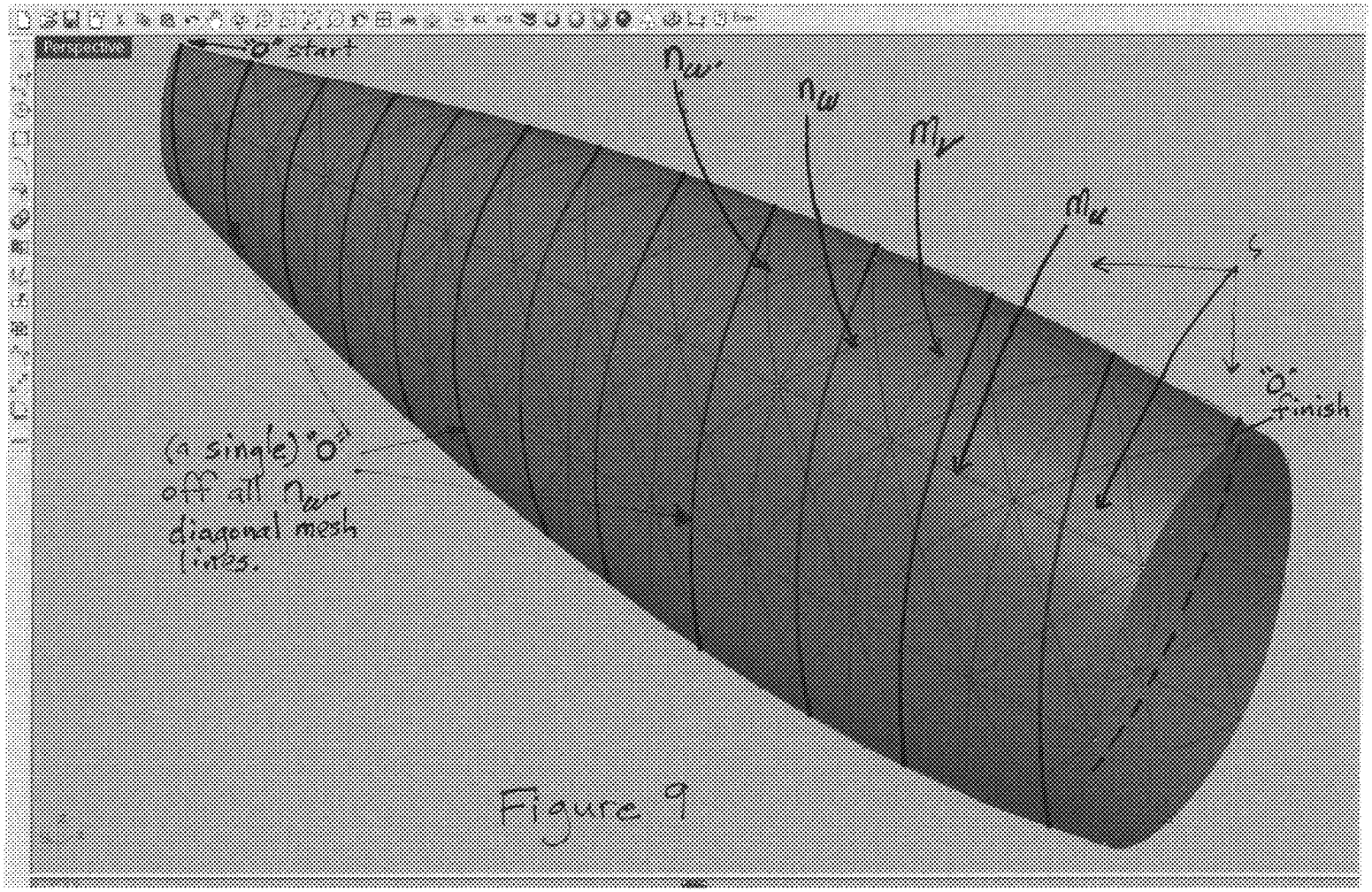

FIG. 9. Illustration of Weft, Warp and Whew battens superimposed on Shaded rendering of Woven Shell.

REFERENCE NUMERALS (LETTERS HEREIN)

Note: alphabetic figure keys are not all used in order due to exploitation in most instances of any mnemonic value they may have.

"a" An Assembly of two or more surfaces, shells or volumes.

"b" A Batten (i.e. a batten, strip, plank, rod, wire, tube, rectangular tube," or any other linear fabrication element used for a Weave).

"d" A straightline length between two adjacent Intersection points on a batten. Prototypically for Weft or unspecified dimension.

"f" Fastener at an "i".

"g" A Girth from one intersection "i" to the next, along the design surface.

"h" (The thickness of Weft—only in the "Key Calculation" in the specification)

"hh" (The thickness of Warp—only in the "Key Calculation" in the specification)

"i" An intersection at a batten crossing.

"j" An interval: any section of batten between two adjacent batten intersections.

"m" A parametric mesh line or an entire parametric mesh.

"n" A diagonalized parametric mesh line (one on dimension w or beyond).

"o" A spiralized (see footnote 1 well below) parametric mesh line.

"p" A spline-surface control line for the u dimension [see just below.]

"q" A spline-surface control line for v.

"s" A shaded spline-based surface, shell or solid.

"t" The nominal (before any contouring) thickness of Weft battens. [—but only in the "Key Calculation" in the specification: the integration variable]

"tt" The nominal thickness of Warp battens.

"ttt" The nominal thickness of Whew battens.

"u" The first parametric dimension, often associated roughly with the Cartesian x; corresponds to the Weft.

"v" The second parametric dimension, roughly orthogonal to u; corresponds to the Warp.

"w" A third parametric dimension, used by Weave for the first or only diagonal Parametric dimension; corresponds to the Whew.

"x" The first Cartesian dimension, often associated with length.

"y" The second Cartesian dimension, often associated with width or height.

"z" The third Cartesian dimension, often associated with depth.

"D" A straightline length between two adjacent intersection points on a Weft batten.

"W" Width of u battens.

"WW" Width of v battens.

"WWW" Width of w battens.

FIG. 1. illustrates the symbol legend used throughout this patent application, which follows as closely as possible the conventional notation both from classic weaving and from CAD's computer curve and surface nomenclature:

The principal parametric direction (dimension) at hand is u, which is here usually associated with the Weft of the criss-crossing parametric mesh at hand (or with whichever dimension in the instance at hand is being treated as the principal one). The second parametric dimension is v and its weaving direction is the Warp.

The width and thickness of the batten material in this Weft are Wand t, and for the Warp, WW and tt. The nominal distance in the instance at hand between intersections, in a straight line, is d (i.e. For the Weft or the the current focus) and for the Warp, D.

W, t, WW, and tt drawn at a particular intersection are not nominal raw material dimensions, but finished fabrication dimensions for that particular intersection's final fastening, otherwise they are the dimensions of the supplied battens before any milling calculated and annotated by Weave.

The third parametric dimension (the first triangulating one—used for preventing or when desired as an unwoven flat-finish surface outer layer) is w and its corresponding weaving domain is Whew. If additional parametric dimensions (which are also weaving layers) are needed, (for instance to provide a flat outer layer outboard of a racking-preventing w, or for shell or solid beam thickening for strength or for sub-assembly joining by Weaveing) then they will have the Parametric Dimensions ww, www, . . . .

DETAILED DESCRIPTION

Weave is a Utility method which proceeds from formal shape definitions of three-dimensional surfaces, shells and/or volumes, through computation, to an optimized and elaborated parametric mesh of that surface, and finally to the fabricated object of final use.

This mesh is in its turn ordinarily augmented to a triangulated mesh to prevent (without any constraint or assistance via fasteners other than the single-pin attachment) racking of the final object, and may also, as desired, be "spiralized" (see footnote 1 well below) to provide physical continuity of construction material (eg. just one batten strip for each Weft, Warp and Whew [and optionally more] parametric dimension, and a great reduction in butt and other splices where strips meet at their own ends).

The density and topology of the mesh is specified by Weave such that the constructed object takes on the shape and measured dimensions of the designed object without explicit registration or alignment. This auto-shaping is guaranteed via the properties of spherical (curved beam edge) triangles (constructed from batten elements whose edges take, as they must, not simple arc curves but the particular 3D spline beam curves dictated during the surface(s) design) constrained precisely in their edge length, interior 3D angles at their intersections, and mutually through their neighbors: in the tangency at the corners (via the mutual flattening of the two or three intersecting battens by the fastening), and in the twist and angular orientation in space at their intersections with their neighbors.

The length of batten material is precisely adjusted between intersections for the extra length required by interweaving the batten elements. This extra length depends on the thickness and width of the battens at the intersection, and on the angles of crossing and the curvature there. That is the essential kernel of Weave's calculation methods.

These triangulated meshes of the original 3D objects (the designed surface(s) or volume(s)), taken as the primary structure of the finished objects of use, may be easily optimized for strength, strain, weight, and other desireable criteria, because there is only one element type for the whole structure, the curved beam of a single material, and one sort of (or no) fastener.

These optimizations are based on the designer's specification of use, material, expected loads, torsions and motions, etc., and of relative weightings of all these in an overall optimization measure.

The Weave process includes post-processes for attaching sub-assemblies of Woven objects, for finishing and/or joining edges, chines & other end conditions of shape, and for surface finishing.

Weave's method also includes annotations for the fabricator in its final outputs from the optimized mesh, whose once uniform size and shape of battens now have continuous optional contouring in both thickness and width, and optionally specially mutually contoured battens at their crossings. These annotations consist of instructions and data necessary or useful for the construction of the final objects. They are either in an output text document or are directly written (eg. engraved, plotted, drawn, or printed) on the final battens fabricated by Weave-generated computer-controlled or Weave-specified manual milling, and they are:

- identification and sequencing of each batten and its parent parametric dimension.
- point of intersection of battens, and at said point: angles of intersection (tangent to the intersection's plane), curvature and twist.
- convex, concave and flat sides of batten.
- "shadow" of each batten crossing on each of its neighbors.
- deviation from developability of each edge of each batten segment between intersections (relative lengths drawn as dashes, which when the lengths of the edges are properly adjusted, become visibly of equal length on left and right of the physical batten during preparation of the battens for construction.
- batten contouring in width and thickness for all noted purposes.
- domains of attachment for other Woven sub-assemblies and final product machinery and accessories.
- type and size of fastening required and its image in place at the intersections.
- type of fastener preparation (countersink, etc., if any) for fastening.

Weave fabrication consists simply and solely of laying out the battens relative to each other (including any over-under interweaving), fastening the battens at their intersections as annotated and providing any surface finish.

Weave is conceived to be particularly suited to freeform surfaces—surfaces other than rectangular prisms, spheres, cylinders and their assemblages (eg. crankshafts, boxy dwellings). However, Weave can produce such "simple" shapes, and this can be particularly useful when other sub-assemblies in the final object are freeform.

Ordinarily Weave surfaces are cubic-spline based to mirror the usual bending and torsional shape properties of real physical beams (herein the physical battens of Woven fabrications) of common materials in their ordinary states (woods, metals, most plastics, most composites, and glasses, and others). When required, Weave can gracefully deal with higher degree curves and surfaces and (of course) can deal with linear (planar) and quadratic surfaces, as a consequence of Weave's reliance on NURBS (or any other formal surface definition treating higher degree curves). Again, this is particularly valuable when an integrated fabrication method is desired for an assembly including two or more Weave's from among the types: freeform shells, developable shells, flat or conic shapes, or those unusual shapes not representable with cubic splines.

Weave takes advantage of the increased thickness and the controllable directionality(s) and potential stiffness (due to the controlled interference of classic Weft & Warp over-and-under weaving and to the conjoined thickness at the crossings of two or more dimensions of battens) to provide (in a single integrated fabric layer) the beam properties arising conventionally from the joining of tension and compression surface plates with intervening shear-resisting flange structure. FatWeave (see below) takes this much further.

An important case of Weave's process for solids (volumes as opposed to relatively thin shells) is Fatweave beams. Here, the two beam faces are Woven as two thin shells but the beam flange domain is not comprised of a plate orthogonal to the faces, or of foam or honeycomb glued to the faces, or of a discete rib system or other relatively homogeneous material to deal with shear forces, but of another Weave occupying the space between the shells and joining them together, usually limited to the battens necessary to resist the forces normally allocated to the flange of a conventional beam. More generally, structural sub-assemblies or other Woven volumes (often called "solids" in CAD/CAM terminology) are realized as a Fatweave with the elements not just limited to those necessary for the specified flange optimization, but constrained or multiplied for other use reasons: for instance a Fatwoven wing might multiply the flange battens (or flat edge-plate stiffeners for them) to serve as fuel baffling, or reduce them in way of the position of a control surface servo or landing gear mechanism, or substitute some tube battens for strips in the outer shells to serve as surface radiators.

General Notes:

- Weave is suited to either professional or amateur construction and design, because 3D solids and surface systems are available in which an inexperienced designer can produce rather complex surfaces and solids which are familiar, or novel, but carefully visualized, and expert designers can produce most any 3D form.
- Weave is intended for markets including industrial/commercial prototyping, hobbyists, and both light and heavy industry, in all of these tasks: design, optimization, marketing and fabrication.
- Because Weave's transformed parametric mesh is the fundamental structure of the completed product, in the design, development and testing phases there is little distinction between simulation, visualization and structural or performance computer testing of the design model and the product. This relative lack of distinction (and the fact that fasteners, if any, are single pins) between design basis and final use object provides for extreme material simplicity, greater accuracy, proof against structural indeterminacy or ambiguity, greater likelihood of legitimate analytic or simulation tests, and opens the door to designs more fully optimizable in terms of using only directly (one-to-one) specific structural elements to accomodate corresponding specific forces, performance loads, vibration, movement and damage; and said lack of distinction provides for the elimination of any other elements. The final use object can more closely resemble a model of the forces and motions that it is designed to encounter, exploit or accomodate.

There are few shapes that Weave cannot model and that could not be quickly and simply constructed to high standards. Some obvious freeform shapes are: furniture such as chairs, vehicle bodies, wings & streamlining appendages, dirigibles & blimps, appliance casings, swimming pools, light shades, sandals, antennae including space telescopes, space data sensors and frames for solar collectors, architectural structures in isolated zones, the ever more common freeform architectural structures such as many of Frank Gehry's buildings, baskets, sails, swimming pools, ultralight beams (perhaps for subsequent more conventional construction), advertising displays, and protective coverings among many others.

Some objects that are not appropriate for Weave are those where the shape or the raw material is inappropriate: glass lenses, cardboard boxes, bricks and cement blocks, architecural flat panels such as wallboard, two-by-fours, chessboards. And many others, including those with shapes and materials that are appropriate, but which are manufactured in large enough numbers that they would be more efficiently "stamped out." However at nano scales it could be more practical to Weave tiny filaments with nanobots than to build tiny mass production facilities or tools.

Re: Surfaces: Thin or Uniform Shells. Although no constructed shells have zero thickness, for thin or uniform shells it may be convenient and entirely satisfactory to create the shell shape and process it through Weave as a pure 3D surface with no material thickness.

Surface Finish

It might seem at first thought that an interwoven (over-under) surface would produce significant difficulty in producing as fair and as smooth a finish as desired. This is not the case. On the other hand, a finished Woven surface may leave some or all of its surface showing some of the Woven surface pattern, when no smooth finish is required, either for simplicity, aesthetics or to identify forthrightly the nature of the structure.

There are many means of giving a Weave a smooth finish, when and where desired. One already indirectly discussed is to not interweave the final layer (the Whew), and to Spiralize it, perhaps interposing a next-to-last additional layer of leveling foam so that the structure as fabricated is inherently smooth.

Another means of achieving a smooth finish is to lay one Woven shell precisely over another "shifted over" one undulation, matching and largely cancelling out the undulations of the Weave.

In that method or others that leave a trace of the woven shape, grinding or sanding of excess material planned into the raw battens, or of an additional foam ballon/resin layer or coating, can produce a smooth finish.

Just as Weave will mill the battens width and thickness to change stiffness, to deal with near-developability, to produce overall desired thickness, or to eliminate or precisely control interstitial voids, the crossing junction locales and immediately adjacent material may be shaped in such a way that a single batten's material in way of each crossing has half (or ⅓ or ¼ or . . . , appropriate to how many layers there are) the thickness of the nominal, giving the crossing the same total thickness as the rest of the Weave, providing a convenient basis for any final finishing to be fair and smooth. Such shaped junctions can be designed to retain most all of the strength and stiffness characteristics of an unshaped crossing.

Analogously (with respect to fair and smooth), in the case of some metals and plastics the crossings can be formed and fastened in a single impact welding motion which reduces the crossing thickness to the nominal Weave thickness and at the same time fastens the crossing battens by the resulting heat weld.

Many-layered Weaves which also fill their volume with some excess, by virtue of the batten material and treatment used, may be directly ground, sanded or planed to fair and smooth by removing material.

And of course non-Weave-specific conventional techniques of or analagous to filling voids with microballoon/resin mixes and fairing with sanding, grinding or planing tools may be used to produce a smooth and fair finish. And many other conventional methods, among them standard surface fibreglassing, fastener removal after curing, taping, filling & painting, and many others.

OPERATION—PREFERRED EMBODIMENT

Weave proceeds by computation from the mathematical definition of three-dimensional surfaces, shells and/or volumes, such as a NURBS file, and again through computation to a parametric mesh of that surface.

Surface Shell or Solid

The origin of the NURBS surface files is entirely open—any solids or surface design system will do (Catia®, Rhino®, FastShip®, or AutoCAD®, ProEngineer®, . . . , among several others)—as long as industry standards for file exchange are followed, such as IGES, STEP, 3DM, 3DS, VRML, or SAT, . . . , in order to facilitate the movement the shape files of origin to whatever CAD system is best for programmatic creation and manipulation of the parametric meshes, and subsequently to move the final batten shapes to whatever, if any, CAM system is best suited to document and/or mill the final battens.

First prescribed is the method for a single shell NURBS origin surface: The NURBS file of said surface or shell is imported into any CAD or CAD/CAM system capable of producing regular parametric meshes (uniform steps in u and v). The density of this initial mesh is taken from an over-conservative (dense) estimate of that required to capture all surface shape elements to the designer's or fabricator's specification of allowable shape deviation, If at the end of transformation of this mesh it is found either not dense enough or much too dense, the density is adjusted in proportion to the measured error and the whole process is reiterated.

FIG. 2. illustrates the freeform computer-spline shape (as a shaded rendering) and its corresponding parametric mesh, which are respectively, the fundamental input and the working basis of Weave—they exactly represent the same surface shape. FIG. 3. illustrates the spline (here NURBS) net control points (and implicitly the net control lines that connect them in a quasi rectangular grid) that define (or "generate") the shape. These shape control points are quite abstract—they do not lie on the surface; they may at first blush be considered to be magnets pulling or pushing a relatively wide domain of the surface. Because they are also very sparse compared to the information in the generated surface, the NURBS or other CAD file in which the shape(s) are recorded and transferred, need carry only the control information.

FIG. 4. presents the weft and warp of an initial (design phase) parametric mesh. The segments between adjoining crossings in the mesh are (even initially) 3D spline curve segments which entirely lie on the freeform surface (not the 3D straightline segments of a "wireframe" rendering of a surface, or arcs or other curves, all of which likely would not lie on said surface). A Parametric mesh is one in which each Weft and Warp curve is at constant u or v values, not curves at constant Cartesian values of x, y or z ("Sections"), nor curves simply lying on the surface but otherwise uncontrolled.

Optimized Parametric Mesh

This parametric mesh in turn is usually augmented (by on or more additional dimensions neither parallel nor orthogonal to u or v) to a triangulated (parametric) mesh, which may also have be then spiralized[1] to provide physical continuity of construction material, greatly limit the number of construction elements (battens), and to provide increased continuity for the woven shell's surface finish.

1 To Spiralize a given parametric direction is to redraw all the curves of one dimension of the parametric mesh so that in a closed surface (one like a beam or sheath or fuselage or basket where at least in one parametric dimension one edge of the surface is mated to its opposite edge to form a contiguous surface), instead of their being several discrete constant u rings spanning the u dimension (each with v running through its entire domain [0→1]), the rings are linked by smoothly running the u value of the first ring up to the u value of the second ring at the mating line of the joined mesh edges, so that a spiral (spanning the entire shell surface) of a single variable-parameter u is created—a single batten replacing the quasi-concentric ones, each having corresponded to a single separate constant u. For example if such a closed surface had eleven evenly (parametrically) spaced rings of u values 0, 0.1, 0.2, . . . , 0.9., , the first ring would have u values running smoothly over [0→0.1 ] as v as usual runs over [0→], and no longer a ring, it becomes the first (parametric) ⅒th piece of a continuous (parametric) spiral.

Triangularization is done when it is required to absolutely prevent racking of the shape which could result from a rectangular mesh, and/or if the self-shaping property of Weave for this Shell cannot be achieved with a rectangular mesh. When wracking is desireable for crushability or flexibility requirements on the constructed assembly, triangularization is not performed, and other means will be employed to limit racking A triangular mesh will ordinarily be interwoven (the layers alternately over and under each other at each intersection in sequence) for two of the three directions of the mesh, and the third direction (third top [outside] layer) may be layed over the first two interwoven, flat, or also interwoven with them. This is one primary choice for the means of smoothing (achieving a satisfactoraly flat and fair surface finish on) an interwoven shell. Other means of smoothing must be used, when for optimal beam strength reasons, the thickness of the shell needs to be maximized (discussed in the General Description above).

The regular meshes emanating direct from the NURBS files for a three-dimensional shell have by their nature, low geometric (not parametric) density where curvature is minimal and high density where curvature is great. Ordinaily this is the opposite of the structural requirements for stiffening and strengthening of a shell constructed to that shape: highly curved domains need only enough density to minimally capture the variations in shape while flat areas need additional density of fabrication elements roughly parallel to the surface, in order to prevent oil-canning and other deflection, twist and puncture.

Thus the initial triangulated mesh density relationship: high for curved areas, low for flattish areas, is locally reversed as much as permitted by the shape retention constraints in the highly curved domains and by the excessive construction weight constraints in the minimally curved or flat domains OR the many strips in curved areas are trimmed to reduce crowding and the few strips in flatter areas are left "too wide, too thick to gain stiffness there.

Self-shaping

The density and topology of the Weave's mesh transformations are such that the constructed object takes on the shape (without explicit alignment, registration, strongback, jigs, molds or other measurement and forcing) and measured dimensions of the designed object, largely through the rigidity properties of quasi-spherical[2] triangles.

There are two major aspects to self-shaping, one topological—strictly concerned with shape—and one of scale—namely that the fabricated object be in all measures of girth and thickness equal to that of the designed object. Simultaneously, these two aspects are also impacted by the distortion of the shape by its own weight (and by externally posed loads). With respect to distortion under load, Weave objects do not differ qualitatively from any other monocoque construction method: they will deform, and Weave will calculate and present the predicted strains. As always the design phase must structure the design elements so that expected stresses do not produce excessive strains One logical demonstration of the accurate and self-shaping of a Weave takes the form of a procedure and is as follows: Consider the final object already built. Now lay a fairly dense (eg. one hundred total triangles) triangulated parametric mesh precisely on it. Then augment the inside of each spherical triangle of the mesh by implanting three triangles within it filling it and sharing its edges so that the whole of each said triangle is now a tetrahedron. Move the peak of said tetrahedron to the highest or lowest point on said triangle (considered in this case to be lying flat on its original outer perimiter. Now eliminate the original body. The mesh of tetrahedrons remains without any change in shape and that is because a solid spherical triangle (any triangle) is a rigid body. All of the points (crossings of the edge curves of all of the 2 These particular three dimensional triangles are constructed from batten elements taking, as they must, not simple arc curves but the particular 3D spline beam curves dictated by the surface design. So they are not truly spherical triangles, and might be called 3D spline- or Beam-Triangles. Note that the shape of batten edges of these 3D spline triangles is only dependent on the design and not significantly on the particular raw material used—wood, plexiglass, carbon composite, fiberglass, aluminum, steel and so on (unless it is an exotic and rare used material such as Memory Metal which does not always adhere to the bent beam shape properties of these 'ordinary' materials). triangles) lie on the original shape and as the density of this mesh is increased continuously improve their approximation of the original shape and approach in the limit the point set of the original shape.

Now make one change in all of the triangles: replace their edges with thin physical beams (battens) clamped at the endpoints they share with their neighbors so that the tangency and twist of the beams at the endpoints s shared (is equal) across every intersection. If there is any interval "j" in this mesh which includes two or more inflections, iterate the entire process, increasing the density of the mesh (only locally to save time and crowding) until there remains no doubly inflected interval. Given the properties of natural 3D beams, the intervals are now of a single unambiguous shape. So these "spline edge" quasi-spherical triangles are rigid as were the straightedges ones.

So a triangulated parametric mesh which is the mesh of quasi-spherical triangles just described, is a rigid body with all its points on the design phase surface and with all girths of any scale or direction (parametric dimension) correct. Further, the intervals "j" are all unambigous and correct as to concavity/convexity (see that part of the method above which ensures that unambiguity via the topology of the over-under crossings in conjunction with girths of correctly adapted said topology and simultaneously to local curvature). Finally, since the interval splines are splines with the correct endpoint conditions they are well beyond the accuracy of the original straight edges they have replaced in approximation the splines of the original shape which obey the same endpoint, tangency, twist, girth and natural 3rd order beam shape conditions. Weave is therefor self-shaping: it can take no other shape than that of the source design.

The Mesh and the Structure are One

These triangulated meshes of the original 3D objects, taken as the primary structure of (and subsequently constructed as) the finished objects of use, are optimized for strengths, weight, stiffness, permeability, crushing energy, direction and location of internal movement and change of shape, smoothness, and interstitial voids. This optimization is based on the designer's input of intended use, the raw material and its nominal dimensions, expected loads and torsions, expected motions, sub-assembly fastening locations, required finish, and the relative weighting of all these inputs in an optimization measure.

Weave fabrication consists of fastening the battens at their intersections as annotated. That is all that is required.

The Key Calculation

The essential mathematical key to generating and assembling battens for self-shaping Weaves is to know, to calculate, the extra length that a batten must have between each intersection to follow the woven in-and-out pattern rather than an independent path without the additional curved length required to weave over and under crossing battens. And to know how to make the necessary adjustments to that underlying calculation for the angles of crossing of the battens, their thicknesses, their widths and their "would be" straightline intervals between unwoven crossings. And finally the adjustment for the local curvature of the shell at a given crossing and its increasing or decreasing effect on the required curvature (and hence length) of the batten material involved in that curvature.

One can express, in a stereotypic example batten crossing, the extra length (that beyond the surface's girth length between adjacent crossings—not straightline 3D length) required can be calculated from these mathematical steps:

The fundamental increase is that attributable to the additional curvature and pathlength that the 3D spline must take on to negotiate the over-under path. This curve is just that which minimizes the changes in curvature from the point where batten in question is tangent to the surface of the crossing batten at one intersection to the point where it is tangent to the crossing batten at the adjacent intersection.

This minimization of curvature change is mathematically identical to that of the minimization of the internal stress energy in the batten between those two same points; and again the same curve as that of a river slowing down as it digs a deeper channel into its banks and bed as it ages or equivalently the curve that a train of many tiny cars would make in crashing—in these two cases one can equivalently express it as the curve which minimizes variations in energy involved in bending of the train (or water flow) due to deceleration. To minimize the energy lost to curvature in a railroad switch link that smoothly joins two straight track ways, the same curve minimizes the variations in decelerations along the track piece introduced to join the existing ways (one symmetrical half of which is expressed in the following mathematical description in the first formula). The overall situation in simplest form is shown in schematic form in FIG. 5.

The Cubic Solution:

The parametric curve (ranging over its domain t) of ½ the "railroad switched link" is $$\left[1-\frac{2[t-(d-W)]}{d-W}\right]\cdot\left(\frac{t}{d-W}\right)^2\cdot(h)$$

Its derivative with respect to its domain parameter is:

$$\frac{d}{dt}\left[\left[1-\frac{2[t-(d-W)]}{d-W}\right]\cdot\left(\frac{t}{d-W}\right)^2\cdot(h)\right]$$

or (solved):

$$6\cdot t\cdot h\cdot\frac{(-t+d-W)}{(d-W)^3}$$

So its girth is:

$$\int_0^{d-W}\sqrt{1+\left[6\cdot t\cdot h\cdot\frac{(-t+d-W)}{(d-W)^3}\right]^2}\,dt$$

In order to calculate not the function's values themselves, but, as needed here for the battens, the length of the curve, its girth, the intermediary step of calculation is given in the second and third formulae, the curve's derivative. Then, as one can with virtually all continuous parametric functions, the general form of the Girth Integral is adapted to this particular derivative function of the third formula, in the fouth one, thus finally arriving at (one-half) of the additional length (girth) required due to the fact alone of the over and under crossing.

Armed with this integral formula one can numerically integrate it in the context of the particular values for thicknesses, widths and nominal spline girth of the crossed battens to give a resulting increased girth between the two crossings.

But, in order to adjust for the angle of crossing of the battens the w width is increased by the cosine of the acute angle of crossing—this appropriately extends the "ledge" of width over which the batten must travel flat against its crossing partner, before entering the transition curve to reverse its under/over position with that partner. Of course there is no adjustment when the crossing is perpendicular, 90 degrees. This "ledge" adjustment is shown in FIG. 6.

Naturally the width (and thickness and crossing angle) at each crossing may differ and thus it is convenient that the formulas above are for one-half of each length between crossings and expressed in terms of thickness, width and crossing angles at the (one side of the) crossing associated with that half.

This first of three corrections is applied first by substituting W+ for W in the "Cubic Solution" equations above.

In order to adjust for the local curvature at the crossing and its attendant increase of "difficulty" for a batten bending in the opposite direction to that curvature in making its over/under transition, and conversely the "easing" of the path of the batten at that crossing bending in the same direction, a smooth transition function is now introduced between these two extremes, in three steps:

First this function must satisfy the criterium that zero adjustment is required if the curvature at the crossing is zero (the crossing is flat).

Second this function must satisfy the criteria that at 45 degrees of "advantageous" bend, the value (which decreases required girth) will be just tt (and it approaches and leaves this value gently (smoothly assymptotic) as it approaches and surpasses 45 degrees. In any case the value beyond 45 is not critical since meshes which try to capture shape contortions with larger angles are likely to self-destruct with or without adjustments in t and tt, at the stressed crossings). This 45-degree "advantageous bend" case is shown in FIG. 7.

Thirdly, the "disadvantageous bend" (increasing the girth) case can be seen as in only partial symmetry to the previous case: the maximum loss of tt is reached at about 45 degrees, and again, gently in approaching the assymptotic max loss, although otherwise the mode of increase in d increment is quite different.

For the same reasons as in the prior case, and a fortiori because of the greater angle, values of "disadvantage" beyond 60 degrees need not be specified because they cannot be used. This third situation is represented in FIG. 8.

The W+ correction having already been made, the last correction to the "Cubic Solution" above is now made by applying the increment (or decrement) in d as just described, for the disadvantageous case (or the advantageous case). As discussed this correction may be zero.

The formulas and Figures above (within the Technical Description) consitute the whole of Weave's adjustments for true woven batten length between crossings, but it is also important, in calculating the true positions of intersections in a Weave, that although the first two layers can be calculated from a single shell definition (their mating surfaces lying directly at and tangent to that single surface), additional layers inside or outside those two must be calculated from an Offset Surface, i.e. one that is in a slightly (exactly the thickness of any and all layers intervening between the additional layer and the mating surface) more outward or inward position (and usually of greater or lesser volume) because of the growing thickness of such a mesh. In other words, in thicker Weaves, d and D increase, at any given crossing, as the mesh thickens outwards.

Annotations

The Weave process also includes, for use by the fabricator (or fabricating machinery), annotations in its final outputs from the optimized final mesh whose once lineal elements now have defined width, thickness and optionally continuous contouring in thickness and width. These annotations comprise instructions and data useful, but other than the intersection point, crossing shadow and optional developable unequal lengths, not necessary, for the construction of the final objects. The annotations are either in a separate text document and/or directly engraved or printed on the final battens fabricated by Weave-generated computer-controlled or Weave-specified manual milling, and they are:

Identification and sequencing of each batten

Point of intersection "i", of battens "b" and angle of intersection (tangent to the intersection's plane) This is marked as a shadow of the outer piece on the inner intersected piece, and vice versa Polar angle of intersection orthogonal to the tangent plane of each intersection Deviation from developability of each edge of each batten segment between intersections Domains of attachment for other Woven sub-assemblies and final product machinery and accessories Type of fastening required and its size and image in place Type of preparation (countersink, etc). for fastening.

Essential Notes:

Fasteners for Weave only pin the crossing battens through one exact point, orthogonal to their plane of crossing—they do not ordinarily constrain or lock the crossing angle, as it is unnecessary, and would often be undesirable to do so (for shape definition or rigidity purposes). The angle is ordinarily fixed by the triangularization of the mesh. In some cases, for shape definition, where there may not be enough neighbors for automatic forcing of shape, the fasteners may be fashioned to dictate curvature of the crossing. Even the usual single-pin fastener controls tangency of any two splines continuing one another at the crossing; this control may also be accomplished without any fastener where the interweaving conditions (eg. tension at the crossing or lack of intersitial space), alone lock the crossings.

Weave is conceived to be particularly suited to freeform surfaces, that is, surfaces other than rectangular prisms, spheres and other conic shells. However, Weave can produce such "simpler" shapes, and this is particularly useful when other sub-assemblies in the final object are freeform.

Ordinarily, Weave surfaces are cubic-spline based to mirror the usual bending and torsional shape properties of natural physical beams (here, the battens of the Woven construction) of common materials in their ordinary states (wood, metal, most plastics, most composites, glass, and so on). When required, Weave can gracefully deal with higher degree curves and surfaces and, of course, can deal with linear and quadratic surfaces.

Dealing with Developabiliy, Near-Developability and Undevelopability

Many freeform surfaces have complex curvature—they cannot be constructed of a small number of initially flat plates simply by giving them rolled curvature that is cylindrical or conic. Such surfaces lack what is called "developability." In the worst case, with an even modestly friable non-ductile material, even in very thin and narrow battens, precisely following the final Woven mesh wiould be impossible, would lead to breakage of the battens during fastening.

Weave can deal with this undevelopability in several different ways:

For instance, if the battens are relatively thin rod, instead of rectangular cross-section battens, and have some capacity for twist without breakage, there will be no problem with undevelopability because a prepatory counter twist permits the battens to relieve the twist generated in following the complex curvature. Larger and larger diameters of the rod however, even a very ductile one, will limit this ability.

Conversely, as rectangular cross-section battens become very narrow, they will be able to follow the complex curvature because the stresses increase across the width of the batten and narrow battens generate stresses small enough to be relieved by the internal strains within the batten.

Weave annotates battens for the length differences between opposite edges between crossings. Where battens are of a ductile or semi-liquid material, automatic or manual rolling, and/or crimping (or differential heating) of these edges can produce the specified necessary edge length differences to allow the rectangular cross-section to exactly follow the complex curvature by exactly removing the stress that would have been generated. Even for non-ductile materials, crimping can sometimes be used to shorten one of the edges.

Many batten materials can be twisted and stressed to follow the curves if, at each crossing, a battens is allowed to "rear up" and twist away from lying flat on its crossing partner. To accomodate this method, Weave calculates a precisely adequate additional increase to inter-crossing girth length, and a fastener is specified whose length and material properties neither force the battens to lie flat at the crossings, nor crush them in the attempt, nor allow them any looseness at the crossing.

Often undevelopable surfaces can be modified in the design stage (even by automatic means) to be developable or sufficiently near to developability to allow fabrication with some of the techniques above, with no unacceptable penalty in the change of shape.

DESCRIPTION—ALTERNATIVE EMBODIMENT

Woven Beams—"FatWeave"

An important case of Weave's process for solids (volumes as opposed to relatively thin shells) is "FatWoven" beams. Here, the two beam faces are Woven as two shells, although the beam flange domain is not a plate orthogonal to the faces, foam or honeycomb glued to the faces, a discete rib system, or other relatively homogeneous material to deal with shear forces, but a Weave occupying the space between the shells and joining them together, limited precisely to battens necessary to resist the forces allocated to the flange of the beam.

More generally, structural sub-assemblies or other Woven volumes (often called "solids" in CAD/CAM terminology) are realized as a FatWeave with the elements limited to those necessary for the specified optimization, or constrained or multiplied for other uses. For example a FatWoven wing might multiply the flange battens to serve as fuel baffling or limit them in way of a control surface servo or landing gear mechanism.

DESCRIPTION—ALTERNATIVE EMBODIMENT

Assemblies

The Weave process includes automatic post-processes for generating additional interweaving for the attachment of sub-assemblies of Woven objects (and written procedures for finishing and/or joining edges, chines and other end conditions of shape, and for surface finishing).

In order to structurally attach two sub-assembly shells or solids, Weave makes up a new surface which joins these two surfaces either—by designer/constructor option—by unifying the two surfaces (and constraining the joint mesh domain to take all of the forces generated on both sides as specified) or by aligning the two meshes' dimensional orientation and introducing additional weave in (at least) two dimensions that overlies the joint plus whatever additional overlap and material is required to meet the strength constraints given in the overall optimization measure for the assembly. The designer/constructor may also explicitly specify the overlap domain. Any necessary reduction in the battens of the initially separate pieces to accomodate additonal parallel and crossing battens is done automatically.

Of course the constructor is free to join the two independent pieces by whatever conventional means desired.

CONCLUSION, RAMIFICATIONS, AND SCOPE

Weave is a general method for designing and fabricating freeform and simpler 3D shells—and volumes and assemblages of same—with very few limitations in any domain of shape or construction environment. Beyond Weave's generality, it is remarkable for the autonomy it provides, freeing the designer/fabricator from spatial, temporal, tool, training, supply, and various environmental constraints. Weave's self-shaping property and its overall simplicity make it unique, and its scope of application nearly unlimited. Also unprecedented is its spare use of resources for a given optimal strength-to-weight design. It is conceivable that construction in hostile, distant, and/or dangerous environments could be radically extended by Weave, and perhaps in industrial prototyping, amateur construction of significant architectural and vehicle structures, crushable structure design and fabrications, and design and fabrication of structures benefiting from new extremes of optimization of weight and structural strength.

The invention claimed is:

1. A method for constructing a three dimensional shell made up of a plurality of flexible battens, starting from a precise definition of a developable or non-developable three dimensional surface shell shape, comprising:

a. calculating from said shape definition an iso-parametric mesh having said shape, b. optionally triangulating said mesh by adding a third parametric dimension, a whew, to a weft and a warp c. providing flexible batten material of predetermined thickness and width, and of length adequate to realize, as one of said battens, each of said mesh's iso-parametric curves as lengthened by the following step, d. calculating from said mesh, the distance from each said parametric curve's ends to their adjoining intersections with other of said parametric curves, and from each said intersection to the next intersection, taking into account the width and thickness of said batten material, and that said battens are to be woven alternately over and under each other, e. accumulating, for each said batten, a sum of the lengths between each said batten's ends and their adjoining intersections, plus the lengths between said batten's adjacent intersections, f. cutting each said batten according to said sum, g. if said surface is non-developable, employing means to modify each of the two lateral edges' lengths of each of said battens, so as to match the differences in length of the two said edges required by any non-developability of said surface in the locality of said batten, h. preparing said battens for fastening at each of their intersections with other of the said battens, and then i. fastening the battens together at said intersections using means to prevent slippage of said battens at the locations of said fastenings, and if said surface has not been triangulated, using means to prevent rotation as well as slippage at said locations, whereby said shell of said shape is constructed.

2. A method for constructing a three dimensional physical shell made up of a plurality of flexible metal battens, starting from a given developable or non-developable NURBS definition of a three dimensional surface shape, comprising:

a. calculating from said shape definition an iso-parametric mesh of two parametric dimensions having said shape, and having an adequate density of iso-parametric curves in each of said dimensions to capture the desired level of detail of form of said shape, b. providing a stock of flexible extruded metal batten material of predetermined thickness and width, and of total length adequate to realize, as one of said battens, each of said mesh's iso-parametric curves as lengthened in the following step, c. calculating from said mesh, the distance from each said parametric curve's ends to their adjoining intersections with other of said parametric curves, and from each said intersection to the next intersection, taking into account the width and thickness of said batten material, and that said battens are to be woven alternately over and under each other, d. accumulating, for each said batten, a sum of the lengths between each said batten's ends and their adjoining intersections, plus the lengths between said batten's adjacent intersections, e. cutting each said batten to a length given by said sum, f. if said shape is non-developable, employing means to modify by shortening crushings and lengthening stretchings, smoothly and continuously, each of the two lateral edges' lengths of each of said battens, so as to match the differences in length of the two said edges required by any undevelopability of said surface in the locality of said batten, g. preparing said battens for fastening at each of their intersections with other of the said battens by means comprising measuring according to the measured lengths between intersections along each batten, marking the said intersections' locations along each batten, pre-drilling a hole of a size appropriate to the fastener to be used at each intersection, and countersinking said hole, h. fastening the battens together at said intersections with rivets, employing means to prevent both slippage and rotation of said battens at the locations of said fastenings, whereby said shell of said shape is constructed.

* * * * *